United States Patent [19]

Schneble, Jr. et al.

[11] 3,959,531

[45] May 25, 1976

[54] ELECTROLESS METAL PLATING

[75] Inventors: Frederick W. Schneble, Jr., Oyster Bay; John F. McCormack, Roslyn Heights; Rudolph J. Zeblisky, Hauppauge, all of N.Y.

[73] Assignee: Photocircuits Corporation, Glen Cove, N.Y.

[22] Filed: July 11, 1974

[21] Appl. No.: 487,739

Related U.S. Application Data

[63] Continuation of Ser. No. 137,024, April 23, 1971, abandoned, which is a continuation of Ser. No. 867,974, Oct. 20, 1969, abandoned, which is a continuation of Ser. No. 523,897, Feb. 1, 1966, abandoned.

[52] U.S. Cl. ..... 427/345; 106/1; 427/304

[51] Int. Cl.[2] ..... C23C 3/02

[58] Field of Search ..... 117/130 E; 427/345, 427/304; 106/1

[56] References Cited

UNITED STATES PATENTS

| | | | |
|---|---|---|---|
| 3,075,855 | 1/1963 | Agens | 117/47 |
| 3,357,854 | 12/1967 | Hayes | 117/130 E |
| 3,361,580 | 1/1968 | Schneble et al. | 106/1 |
| 3,460,952 | 8/1969 | Saubestre et al. | 106/1 |
| 3,578,469 | 5/1971 | Hudd et al. | 106/1 |

*Primary Examiner*—Ralph S. Kendall

[57] ABSTRACT

Electroless metal deposition solutions are provided which comprise, in combination, an ion of a metal whose electroless metal deposition is desired; a complexing agent for said ion; a reducing agent for said ion; a pH regulator; and less than about 25 parts per million of metal ions which have an oxidation potential greater than the oxidation potential of the ion of the metal whose electroless deposition is desired.

6 Claims, No Drawings

ELECTROLESS METAL PLATING

CROSS-REFERENCE TO RELATED APPLICATIONS

This application is a continuation of copending Ser. No. 137,024, filed Apr. 23, 1971, now abandoned, which in turn is a continuation of Ser. No. 867,974, filed Oct. 20, 1969, now abandoned, which in turn is a continuation of Ser. No. 523,897, filed Feb. 1, 1966, now abandoned.

The present invention relates to electroless metal deposition and more particularly to reducing extraneous metal deposition from electroless metal deposition solutions.

Electroless or autocatalytic metal deposition solutions are characterized by a capacity to deposit metal on a wide variety of conducting and non-conducting or insulating surfaces without the assistance of an external supply of electrons. Typically, such solutions comprise a solvent, a supply of ions of a metal to be deposited, an agent capable of reducing the ions of the metal to be deposited, a complexing agent for the ions of the metal to be deposited and a pH regulator.

Such solutions are particularly suitable for metallizing insulating substrata on surfaces which have been suitably treated to make them sensitive to the reception of electroless metal deposition. Such sensitization techniques include the well known treatment with an acidic aqueous solution of stannous chloride ($SnCl_2$), followed by treatment with a dilute aqueous acidic solution of palladium chloride ($PdCl_2$). Alternately, sensitization may be achieved by treating the insulating substrata with an acidic solution containing a mixture of stannous chloride and precious metal chloride, such as palladium chloride, the stannous chloride being present in stoichiometric excess, based on the amount of precious metal chloride.

Alternate ways of achieving good sensitization of insulating substrata to the reception of electroless copper are disclosed in co-pending application Ser. No. 249,063, filed Jan. 2, 1963 and U.S. Pat. No. 3,146,125.

Heretofore, difficulty has been experienced in accurately depositing electroless metal on closely defined, sensitized areas of insulating surfaces. There is a tendency for non-sensitized areas of such surfaces, following prolonged immersion in or contact with electroless metal solutions to receive scattered or random deposits of electroless metal. As will be appreciated, deposition of electroless metal on surface areas where metal is not desired, is not tolerable in the preparation, for example, of printed circuits. Such undesired, random or scattered deposition of electroless metal on non-sensitized areas of the insulating surface will herein sometimes be referred to as extraneous metal deposition.

The present invention has for an object the elimination or reduction of extraneous metal deposition from electroless metal, plating solutions.

Another object is the provision of novel and improved processes and compositions by which the uncontrolled spread of electroless deposited metal into unwanted areas of an insulating base is substantially prevented.

A further object of the present invention is the provision of novel and improved processes and compositions by which printed circuits are more accurately and reliably produced than has heretofore been customary or possible.

The present invention also has a further object the stabilization of electroless metal deposition solutions, including the avoidance or reduction of the tendency of such solutions to spontaneously decompose.

Other objects and advantages of the invention will be set forth in part hereinafter and in part will be obvious herefrom, or may be learned by practice with the invention, the same being realized and attained by means of the steps, processes, compositions, instrumentalities and combinations pointed out in the appended claims.

Although for clarity of description, the invention will be particularly described with reference to electroless copper deposition, which is a preferred embodiment, it should be understood that the principles of the invention are applicable to the electroless deposition of other metals.

According to the present invention, it has been discovered that extraneous metal deposition in non-sensitized areas of insulating surfaces may be avoided or substantially reduced by maintaining the electroless metal solutions free or substantially free of metallic ions which have an oxidation potential greater than the oxidation potential of the ion of the metal sought to be electrolessly deposited.

The expression "oxidation potential" used herein should be understood as having the definition set forth in Latimer, *Oxidation Potentials*, 2nd Ed., Prentice Hall, 1952.

The precise mechanism by which electroless metal, e.g., copper, deposition occurs is complex and difficult of precise definition. Without wishing to be limited thereto, the ensuing theory affords a rational explanation for this phenomenon.

In electroless copper deposition from a solution containing a solvent, source of cupric ions, a reducing agent for cupric ions, a complexing agent for cupric ions, and a pH regulator, the reducing agent is oxidized at sensitized deposition surface areas to release electrons to such areas. Cupric ions in contact with the areas containing free electrons released by the reducing agent pick up the free electrons and are reduced to copper atoms, which deposit on the adjacent surface areas and aggregate atoms to form a copper metal deposit.

The potential at which the process takes place is a compromise, or mixed potential, between the two potentials which characterize oxidization of the reducing agent and the reduction of the cupric ions.

In one embodiment of a particularly useable electroless copper deposition solution, the reducing agent is formaldehyde, and the source of the cupric ions is a copper salt, such as cupric sulfate. Using the mixed potential theory heretofore described, the formaldehyde is oxidized to hydrogen and formate ion at the sensitized surface at which deposition is occurring, and an electron is given up to the surface for each molecule of formaldehyde oxidized. The released electrons are in turn taken up by cupric ions at or in contact with the surface, to cause local deposition of copper.

When ions which have an oxidation potential greater than the oxidation potential of cupric ion are present in the solution, the following reactions occur at or in the near vicinity of the surface at which deposition is occurring:

$$M^{n} + Cu^{+2} \rightarrow M^{n+1} + Cu^{+1} \qquad (1)$$

$$Cu^{+1} + [H] \rightarrow Cu^{\circ}\,(\text{atomic}) + H^{+} \quad (2)$$

$$Cu^{\circ} \xrightarrow[\text{Irregularities}]{\text{Dirt}} Cu\,(\text{metal}) \quad (3)$$

$$M^{n+1} + 1 \xrightarrow[\text{Surface}]{\text{Copper metal}} M^{n} \quad (4)$$

In Equations 1–4, n is the valence of the ion M which has an oxidation potential greater than cupric ion.

The hydrogen in Equation 2, it will be remembered, is a product of the oxidation of the reducing agent.

The reactions represented by Equations 1–4 occur independently of the main reaction and compete with the main reaction. Further, the Equation 3 reaction will occur wherever dirt or irregularities are present at the surface. This means that copper metal will deposit randomly in spots containing dirt or irregularities, even though such spots are not or were not intentionally sensitized to the reception of the electroless copper.

According to the present invention it has been discovered that extraneous deposition tends to occur when iron is present in electroless copper plating solutions of the type described.

When iron is present even in very small amounts, the following reactions occur at or near the surface at which the electroless copper is depositing, independently of the main copper deposition reaction:

$$Fe(OH)_2 + OH^{-} + Cu^{+2} \rightarrow Fe(OH)_3 + Cu^{+1} \quad (5)$$

$$Cu^{+1} + [H] \rightarrow Cu^{\circ}\,(\text{atomic}) + H^{+} \quad (6)$$

$$Cu^{\circ} \xrightarrow[\text{Irregularities}]{\text{Dirt}} Cu\,(\text{metal}) \quad (7)$$

$$Fe(OH)_3 + e \xrightarrow[\text{surface}]{\text{copper (metal)}} Fe(OH)_2 \quad (8)$$

It will be apparent from Equations 5–8, inclusive, that ferrous ions in solution continually reduce cupric ions to the cuprous state and are oxidized to the ferric state [Equation 5]. The cuprous ions are reduced to atomic copper by hydrogen [Equation 6]. Hydrogen is present wherever the main deposition reaction is occurring, including areas adjacent thereto, as has been brought out hereinabove. The atomic copper aggregates wherever dirt or irregularities are present to form copper metal (Equation 7), thereby leading directly to the phenomenon referred to herein as extraneous metal deposition. Finally, to complete the cycle, ferric ions pick up electrons from areas at which the main deposition reaction is occurring and are reduced to ferrous ions [Equation 8]. These side reactions are particularly insidious because if nothing is done to prevent them, they are selfperpetuating. Accordingly, the presence of even minute quantities of iron in solution, e.g., less than 25 parts per million, has been found to lead to the formation of extraneous copper deposits.

Dissolved elements other than iron which form ions having an oxidation potential greater than the oxidation potential of cupric ion should also be eliminated or minimized in the operation of electroless copper deposition solutions of the type described. Elements which form ions which have an oxidation potential of greater than −0.153 volts fit this description. Such elements include the following: tin, mercury, silver, chromium, manganese, thallium and the like.

It will be appreciated from the foregoing, that the mechanism for the production of extraneous copper is fundamentally different from that for the production of the main electroless copper deposition reaction.

Summarizing what has been brought out above, according to the present invention, extraneous copper is attributable in part to the presence in the electroless copper deposition solution of ions, principally of iron, having an oxidation potential greater than the oxidation potential for cupric ion. Ferrous ion reduces the cupric ion to cuprous ion and is in turn oxidized to ferric ion. Ferric ions are then reduced back on the active copper surface to ferrous ions, taking part in electron transfer exchange so that quite a small amount of iron in the ferrous state achieves the continuous reduction of cupric ions to cuprous ions.

The ions in the cuprous state then can easily undergo reduction by gaseous hydrogen, but only in the region where this gaseous hydrogen exists in great amounts, that is to say, near points where it is generated or evolved on the active surface.

As will be clear from the foregoing, elimination or reduction of dissolved iron in electroless deposition solutions will lead to the reduction of extraneous copper deposits.

Similarly, the elimination or reduction from electroless metal solutions of ions with oxidation potentials greater than the oxidation potential of the ion of the metal sought to be deposited will lead to the reduction of extraneous metal deposition generally.

It has also been discovered that the reduction or substantial elimination from electroless metal deposition solutions of ions which have an oxidation potential greater than the oxidation potential of the ion of the metal sought to be electrolessly deposited also alleviates the problem of spontaneous decomposition ordinarily associated with such solutions.

Electroless metal plating solutions have a tendency to spontaneously decompose. Such decomposition has been discovered to be the result of particles of metal forming away from the surface on which deposition is occurring, i.e., in the body of the solution.

For example, when iron is present in an electroless copper solution, extremely small nuclei of copper metal form in the main body of the solution away from the deposition surface on which the main copper reduction reaction is proceeding in accordance with reactions 5 and 6, supra. The number of these copper nuclei increase with time, and the nuclei themselves, which also grow with time, eventually reach a size such that they can themselves serve as catalytic sites on which the main copper reduction action can occur. Eventually, the number of nuclei which have grown to a size sufficient to cause them to function as catalytic sites reaches such a proportion that the main reaction proceeds predominantly on such sites. This phenomenon is referred to herein as "spontaneous decomposition."

Reduction or substantial elimination of the iron in such solutions as taught herein avoids the tendency of the solutions to go spontaneous for the reason that reduction of the iron will reduce the tendency for reactions 5 and 6, supra, to occur.

The present invention therefore contemplates stabilization of electroless metal deposition solutions and the avoidance of spontaneous decomposition of such baths by the reduction or substantial elimination from such baths of ions which have an oxidation potential greater than the oxidation potential of the ion of the metal whose deposition is desired.

For best results, the content of such ions having an oxidation potential greater than the oxidation potential of the ion whose deposition is sought should be maintained at a level less than about 25 parts per million and preferably less than 15 parts per million. Particularly good results are achieved when the concentration of deleterious ions of the type described herein is maintained below about 10 parts per million.

Typical of the electroless metal deposition solutions of this invention are electroless copper solutions, which comprise water, a source of cupric ions, e.g., a copper salt, a reducing agent for cupric ions, a complexing agent for cupric ions, and a pH regulator.

The selection of the water soluble copper salt for such baths is chiefly a matter of economics. Copper sulfate is preferred for economic reasons, but the halides, nitrates, acetates and other organic and inorganic acid salts of copper may also be used.

Rochelle salts, the sodium (mono-, di-, tri-, and tetrasodium) salts of ethylenediaminetetraacetic acid, nitrilotriacetic acid and its alkali salts, gluconic acid, gluconates, and triethanolamine are preferred as copper ion complexing agents, but commerically available glucono - $\gamma$ - lactone and modified ethylenediamineacetates are also useful, and in certain instances give even better results than the pure sodium ethylenediaminetetraacetates. One such material is N-hydroxyethylethylenediaminetriacetate. Other materials suitable for use as cupric complexing agents are disclosed in U.S. Pat. Nos. 2,996,408, 3,075,856, 3,075,855 and 2,938,805.

Copper reducing agents which have been used in alkaline electroless metal baths include formaldehyde, and formaldehyde precursors or derivatives, such as paraformaldehyde, trioxane, dimethyl hydantoin, glyoxal, and the like. Also suitable as reducing agents in alkaline baths are borohydrides, such as alkali metal borohydrides, e.g., sodium and potassium borohydride, as well as substituted borohydrides, e.g., sodium trimethoxyborohydride. As reducing agents in such baths may also be used boranes, such as amine borane, e.g., isopropylamine borane, morpholine borane, and the like.

Typical of the copper reducing agents for use in acid electroless copper solutions are hyposphosphites, such as sodium and potassium hypophosphite, and the like.

The pH adjustor or regulator may consist of any acid or base, and here again the selection will depend primarily on economics. For this reason, the pH adjustor on the alkaline side will ordinarily be sodium hydroxide. On the acid side, pH will usually be adjusted with an acid having a common anion with the copper salt. Since the preferred copper salt is the sulfate, the preferred pH adjustor on the acid side is the sulfuric acid.

Every constituent in the electroless copper bath has an effect on plating potential, and therefore must be regulated in concentration to maintain the most desirable plating potential for the particular ingredients and conditions of operation. Other factors which affect internal plating voltage, deposition quality and rate include temperature and degree of agitation, in addition to type and concentration of the basic ingredients mentioned.

According to the present invention, such electroless copper solutions are operated on a substantially iron-free basis in order to prevent extraneous copper deposition. Iron-free baths may be obtained or maintained in a variety of ways.

For example, iron-free ingredients may be selected to make up or replenish the solution.

Copper or copper salts represent a potential source of iron, which is usually present therein as an impurity. Care could therefore be used to select iron-free copper or copper salts.

Alternatively, commercial grade copper or copper salts could be treated to remove the iron impurity. For example, copper solutions could be subjected to ion exchange to remove the iron impurity. Or a solution of copper salts could be treated to precipitate iron, after which the iron precipitate could be filtered out.

Similarly, the other ingredients making up the electroless copper solution, e.g., the water, the complexing agent for cupric ion, the reducing agent and/or the pH regulator could be produced or selected on an iron-free basis, or suitably treated to remove iron prior to use either in making up or replenishing the electroless copper solution.

According to a further embodiment, the electroless plating solution itself, following make-up and/or at periodic intervals during use, could be treated to remove iron which builds up with operation of the solution, the build-up having been caused by the use of starting or replenishing materials which contain iron impurities. According to this embodiment, a portion of the electroless copper solution may be continuously or periodically withdrawn, suitably treated to remove iron, and then recycled to the main body of solution. Alternatively, the entire electroless copper plating bath could be treated at periodic intervals to remove iron. In both these embodiments, a typical treatment to remove iron would include adjusting the pH of the solution to a value of about 12.5 to 13, preferably about 12.8, with a strong alkali, such as sodium hydroxide or ammonium hydroxide, to thereby precipitate the iron as ferric hydroxide, following which the ferric hydroxide could be filtered off. Flocculating aids could be utilized if desired to aid in the precipitation.

Solvent extraction techniques afford still another procedure for removing iron from the starting materials or from the electroless metal solution itself.

A typical electroless metal deposition bath made according to the present invention will comprise:

| | |
|---|---|
| Electroless metal salt | 0.002 to 1.0 moles |
| Reducing agent | 0.03 to 4 moles |
| Electroless metal complexing agent | 0.7 to 40 times the moles of metal salt |
| Ions having an oxidation potential greater than the oxidation potential of the electroless metal ion | less than 25 ppm |
| pH adjustor | sufficient to give desired pH |
| Water | sufficient to make 1 liter. |

In the preferred embodiments of the invention, the electroless metal salt will be a copper salt.

Specific embodiments of a high plating potential electroless copper solution comprise:

| | |
|---|---|
| Copper salt | 0.002 to 1.0 moles |
| Formaldehyde | 0.03 to 4 moles |

-continued

| | |
|---|---|
| Copper ion complexing agent | 0.7 to 40 times the moles of copper |
| Iron | less than 25 ppm |
| Alkali metal hydroxide | sufficient to give pH of 10 – 14 |
| Water | sufficient to make 1 liter. |

Preferred embodiments of highly active electroless copper solutions comprise:

| | |
|---|---|
| A soluble cupric salt, preferably cupric sulfate | 0.002 to 0.60 moles |
| Alkali metal hydroxide, preferably sodium hydroxide, to give | pH of 10 – 14 |
| Formaldehyde | 0.03 to 1.3 moles |
| Cupric ion complexing agent | 0.7 to 15 times the C. of copper |
| Sodium cyanide | .00005 to 0.01 mole |
| Iron | less than 10 ppm |
| Sulfur compound | 0.001 to 1 ppm |
| Water | sufficient to make 1 liter. |

In considering the general and specific working formulae set forth herein, it should be understood that as the baths are used up in plating, the ingredients will be replenished from time to time. Also, it is necessary to monitor the pH, and the concentration of the deleterious ion described herein, and to adjust them to their optimum value as the bath is used.

For best results, surfactants in an amount less than about 5 grams per liter may be added to the baths. Typical of suitable surfactants are organic phosphate esters, and oxyethylated sodium salts.

Typical examples of electroless copper deposition baths prepared following the teachings described herein are as follows:

EXAMPLE 1

| | |
|---|---|
| Copper sulfate | 14 grams |
| Rochelle salt | 70 grams |
| Sodium hydroxide | 20 grams |
| Formaldehyde (37%) | 40 ml. |
| Sodium cyanide | 10 mg. |
| Surfactant | 1 gram |
| Sulfur compound | 0.001 to 1 ppm |
| Water | to make 1 liter |
| Temperature | 30° C. |

EXAMPLE 2

| | |
|---|---|
| Copper sulfate | 5 grams |
| Trisodium N-hydroxyethyl-ethylenediaminetriacetate (41% solution) | 15 ml. |
| Sodium cyanide | 10 mg. |
| Thiourea | 0.05 mg. |
| Formaldehyde (37%) | 6 ml. |
| Wetting agent | 1 gram |
| Sodium hydroxide | 2 grams |
| Water | to make 1 liter |
| Temperature | 45° C. |

EXAMPLE 3

| | |
|---|---|
| Copper sulfate | 10 grams |
| Tetrasodium ethylene-tetraacetate | 20 grams |
| hydroxyisobutyronitrile | 20 mg. |
| Potassium polysulfide | 0.6 mg. |
| Formaldehyde (37%) | 6 ml. |
| Wetting agent | 1 gram |
| Sodium hydroxide | 3 grams |
| Water | to make 1 liter |

EXAMPLE 3-continued

| | |
|---|---|
| Temperature | 60° C. |

EXAMPLE 4

| | |
|---|---|
| Copper sulfate | 5 grams |
| Trisodium N-hydroxyethyl-ethylenediaminetriacetate (41% solution) | 15 ml. |
| Sodium hydroxide | 2 grams |
| Formaldehyde (37%) | 6 ml. |
| Sodium cyanide | 10 mg. |
| Potassium thiocyanate | 0.2 mg. |
| Surfactant | 1 gram |
| Water | to make 1 liter |
| Temperature | 45° C. |

EXAMPLE 5

| | |
|---|---|
| Copper sulfate | 5 grams |
| Trisodium-N-hydroxyethyl-ethylenediaminetriacetate (41% solution) | 15 ml. |
| Chloroacetonitrile | 2 grams |
| Potassium polysulfide | 0.6 mg. |
| Formaldehyde (37%) | 6 ml. |
| Wetting agent | 1 gram |
| Sodium hydroxide | 2 grams |
| Water | to make 1 liter |
| Temperature | 45° C. |

EXAMPLE 6

| | |
|---|---|
| Copper sulfate | 10 grams |
| Tetrasodium ethylene-diaminetetraacetate | 20 grams |
| Lactonitrile | 30 mg. |
| Potassium thiocyanate | 0.5 mg. |
| Formaldehyde (37%) | 6 ml. |
| Wetting agent | 1 gram. |
| Sodium hydroxide | 3 grams |
| Water | to make 1 liter |
| Temperature | 56° C. |

EXAMPLE 7

| | |
|---|---|
| Copper sulfate | 5 grams |
| Trisodium nitrilotriacetic acid (40% solution) | 23 ml. |
| 2-Mercapto benzol thiazole | 0.07 to 0.1 mg. |
| Formaldehyde (37%) | 10 ml. |
| Sodium hydroxide | 2.1 grams |
| Wetting agent | 2.5 grams |
| Water | to make 1 liter |
| Temperature | 20° C. |

EXAMPLE 8

| | |
|---|---|
| Copper sulfate | 5 grams |
| Trisodium N-hydroxyethyl-ethylenediaminetriacetate (41% solution) | 15 ml. |
| Sodium cyanide | 10 mg. |
| Thiourea | 0.01 mg. |
| Formaldehyde (37%) | 6 ml. |
| Wetting agent | 1 gram |
| Sodium hydroxide | 2 grams |
| Water | to make 1 liter |
| Temperature | 45° C. |

The surfactants in Examples 1 to 8 may be either of those mentioned hereinabove.

For best results, the electroless copper solutions will ordinarily contain small effective amounts of cyanide compounds, e.g., 0.00001 to 0.06 mole per liter.

As the cyanide component may be mentioned alkali cyanides, such as sodium and potassium cyanide and nitriles such as alphahydroxynitriles, e.g., glycolonitrile and lactonitrile.

The copper solutions may also contain small effective amounts, e.g., less than about 100 parts per million, of sulfur compounds capable of forming stable but dissociable chelates with cuprous ion.

Among the organic sulfur compounds may be mentioned the following: thio derivatives of alkyl glycols, such as 2,2'-thiodiethanol, dithiodiglycol, aliphatic sulfur-nitrogen compounds, such as thiocarbamates, e.g., thiourea; 5-membered heterocyclics containing S-N in the 5-membered ring, such as thiazoles and iso-thiazoles, and thioglycolic acid; e.g., thiazole, 2-mercapto benzol thiazole and the like; dithiols, e.g., 1,2-ethanedithiol and the like; 6-membered heterocyclics containing S-N in the ring, such as thiazones, e.g., 1,2-benzisothiazine, benzothiazine, and the like; thioamino acids, such as methionine, cystine, cysteine, and the like. Among the inorganic sulfur compounds may be mentioned: alkali sulfides, e.g., sodium sulfide, potassium sulfide, sodium polysulfide, potassium polysulfide; alkali thiocyanates, such as soidum-potassium thiocyanates.

Compounds which contain both sulfur and cyanide are known and may be used as the cuprous complexing agent. Typical of such compounds are 3,3'-thiodipropionitrile and homologs.

For most sulfur compounds 1 part per million will be too much, it will stop the bath. In general the amount will be less than 1 part per million and usually 0.01 to 0.2 part per million will be the preferable range.

In use, the iron content of the solutions of Examples 1–8 will be maintained below 10 parts per million.

As a further aid in reducing extraneous metal deposition, care should be used to insure that the surface being plated is clean and free of dirt wherever possible. Smooth glossy surfaces or highly polished surfaces are especially suitable in keeping extraneous metal deposition to a minimum.

When mention is made of dirt on a surface herein, what is referred to are sharp nucleating centers on the surface caused by surface imperfections. Such surface imperfections or dirt serve as nucleating sites for the atomic copper produced by the reduction of cuprous ion by hydrogen [see Equations 6 and 7, supra] and are to be avoided or minimized to the extent possible.

AS has been brought out heretofore, the solutions described herein are advantageous for use in the production of printed circuits. For example, portions of the surface of an insulating substratum in the form of a desired circuit pattern may be sensitized for the reception of electroless metal. Following sensitization, the substratum is immersed in or otherwise contacted with the electroless metal solution of the type described and permitted to remain therein until a metal deposit of the desired thickness has been built up. The circuit may be formed on one or more surfaces of the substratum. If desired, interconnections between the surfaces may be provided by drilling or punching holes and sensitizing the lateral walls thereof prior to exposure of the substratum to the electroless metal solution. In this embodiment, electroless metal builds up on the circuit pattern and on the walls surrounding the holes.

The sulfur containing baths described herein are remarkable in the sense that they will deposit copper on non-metallic surfaces only in those areas which have been sensitized to provide catalytically active sites, as described for example hereinabove. These baths have a remarkable capacity for distinguishing non-metallic areas which have not been so sensitized from those which have, and for depositing copper only on the latter areas. Even though a non-pretreated, non-metallic surface, including the housing walls of the baths, may be exposed to such baths for prolonged periods of time, random spot deposition on such areas is kept to a minimum.

The invention in its broader aspects is not limited to the specific steps, processes and compositions shown and described but departures may be made therefrom within the scope of the accompanying claims without departing from the principles of the invention and without sacrificing its chief advantages.

We claim:

1. In a method for electrolessly depositing metal by contacting a surface sensitive to the reception of electroless metal with an electroless metal deposition solution comprising an ion of a metal whose electroless metal deposition is desired, an agent capable of reducing said ion to the metallic state, a complexing agent for said metal ion and a pH adjustor, the improvement for reducing extraneous metal deposition of the metal to be deposited which comprises removing from the components which will make up said solution iron ions until the aggregate content of said iron ions in said components is not more than 25 parts per million and thereafter maintaining the content of said iron ions in said solution at an aggregate content of not more than 25 parts per million by replenishing the components depleted from said solution during electroless metal deposition with components from which iron ions have been removed.

2. In a method as recited in claim 1 in which said iron ions are removed and thereafter maintained at a content of not more than 15 parts per million.

3. In a method as recited in claim 2 in which said iron ions are removed and thereafter maintained at a content of not more than 10 parts per million.

4. In a method for electrolessly depositing metal by contacting a surface sensitive to the reception of electroless metal with an electroless deposition solution comprising an ion of a metal whose electroless metal deposition is desired, an agent capable of reducing said ion to the metallic state, a complexing agent for said metal ion and a pH adjustor, the improvement for reducing extraneous metal deposition of the metal to be deposited which comprises establishing an electroless deposition solution containing in the aggregate not more than 25 parts per million of iron ions and thereafter maintaining the content of said iron ions in said solution at an aggregate content of not more than 25 parts per million by replenishing the components depleted from said solution during electroless metal deposition with components having an iron content such that the aggregate content of said iron ions in said solution does not exceed 25 parts per million.

5. In a method as recited in claim 4 in which said electroless deposition solution contains not more than 15 parts per million of iron ions and is replenished with components such that the aggregate content of said iron ions does not exceed 15 parts per million.

6. In a method as recited in claim 4 in which said electroless deposition solution contains not more than 10 parts per million of iron ions and is replenished with components such that the aggregate content of said iron ions does not exceed 10 parts per million.

* * * * *